US006523212B2

(12) United States Patent
Cesak et al.

(10) Patent No.: US 6,523,212 B2
(45) Date of Patent: Feb. 25, 2003

(54) PUSH BROOM BRACKET DEVICE

(75) Inventors: Wieslaw Cesak, Ozone Park, NY (US); Vincent Amabile, Woodhaven, NY (US); Cosmo Amabile, Kew Garden Hills, NY (US); Salvatore Amabile, Woodhaven, NY (US); Daniel P. Dundara, Manhasset, NY (US)

(73) Assignee: Cosmo Interior and Exterior Construction, Inc., Woodhaven, NY (US)

( * ) Notice: Subject to any disclaimer, the term of this patent is extended or adjusted under 35 U.S.C. 154(b) by 0 days.

(21) Appl. No.: 09/802,268

(22) Filed: Mar. 8, 2001

(65) Prior Publication Data

US 2002/0124341 A1 Sep. 12, 2002

(51) Int. Cl.[7] ..... A46B 15/00; B25G 3/12
(52) U.S. Cl. ..... 15/175; 15/146
(58) Field of Search ..... 15/171, 175, 143.1, 15/145, 146; 16/110.1, 422

(56) References Cited

U.S. PATENT DOCUMENTS

| | | | | |
|---|---|---|---|---|
| 117,192 | A | * | 7/1871 | Middleton |
| 651,028 | A | * | 6/1900 | Dryden |
| 931,290 | A | * | 8/1909 | Frazier |
| 1,621,273 | A | * | 3/1927 | Read |
| 2,703,424 | A | * | 3/1955 | Nicoli |
| 4,169,297 | A | * | 10/1979 | Weihrauch |
| 4,541,139 | A | | 9/1985 | Jones et al. ..... 15/171 |
| 4,550,829 | A | | 11/1985 | Strahs ..... 206/361 |
| 4,901,392 | A | | 2/1990 | Shapiro et al. ..... 15/172 |
| 5,094,564 | A | * | 3/1992 | Tedrick |
| 5,502,862 | A | * | 4/1996 | Vosbikian |
| 5,568,668 | A | * | 10/1996 | Margolin |
| 6,349,444 | B1 | * | 2/2002 | Sander |
| 6,393,647 | B1 | * | 5/2002 | Libman |

* cited by examiner

*Primary Examiner*—Terrence R. Till
(74) *Attorney, Agent, or Firm*—Milde & Hoffberg, LLP

(57) ABSTRACT

A push broom bracket device for connecting a rectangular-shaped broom brush head of a given length to a rod-shaped handle. The device includes a sheet-like member in the form of an isosceles triangle having a base edge and two side edges of equal length extending to an apex, the base edge having a length which is greater than one-half of the given length but less than the given length of the brush head, the two side edges forming an angle of substantially 45° at the apex, and the sheet-like member being bent along a line extending substantially parallel to the base edge to form two substantially planar sections which intersect at an angle of substantially 35°, the section adjacent the base edge being adapted for attachment to a top portion of the brush head. The device also has a tube-like member, having a longitudinal central axis, attached to the sheet-like member at the apex with the central axis extending substantially perpendicular to the base edge, the tube-like member being adapted for attachment to one end of the handle. When attached to the brush head and the handle, the bracket device minimizes the lateral forces applied to the handle at the point of attachment during use of the broom.

10 Claims, 2 Drawing Sheets

FIG.1
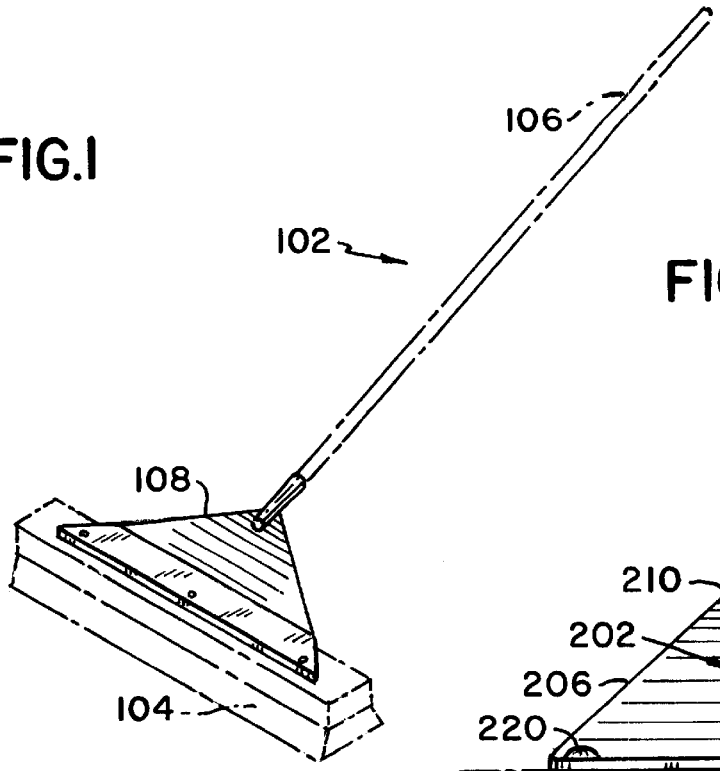
FIG.2
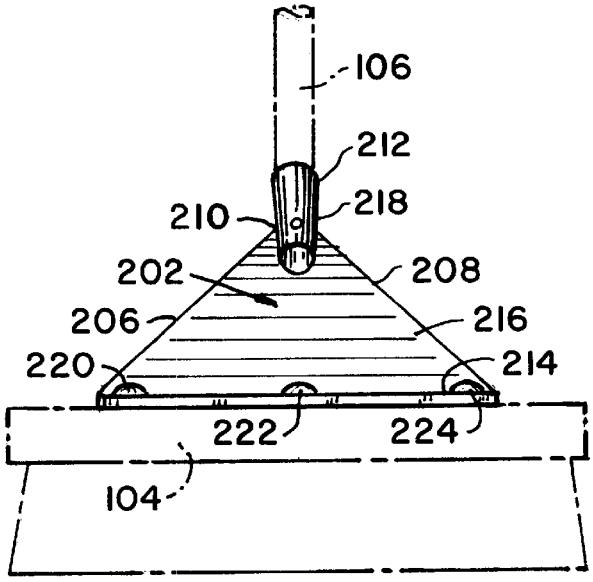
FIG.3
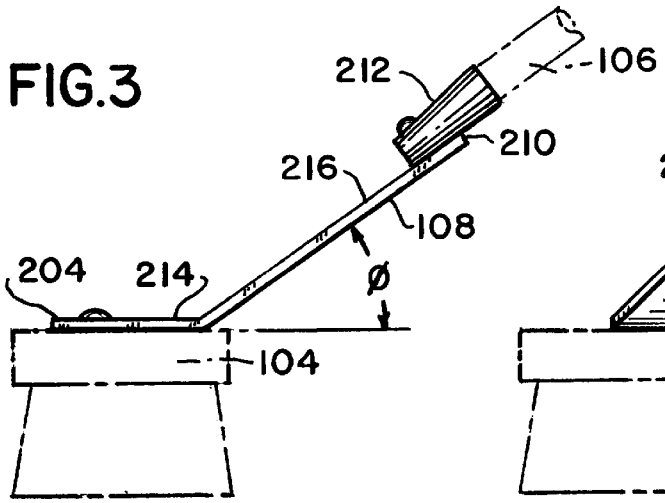
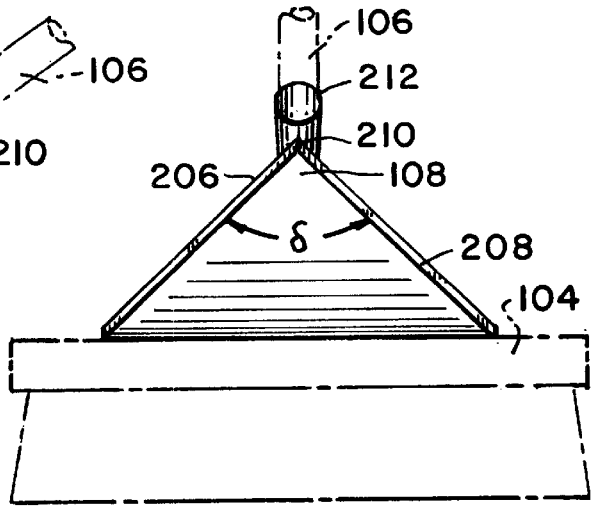
FIG.4

PUSH BROOM BRACKET DEVICE

FIELD OF THE INVENTION

This invention relates to the fields pertaining to push brooms and cleaning equipment. More particularly, this invention relates to a device for connecting a brush head and handle of a push broom.

BACKGROUND OF THE INVENTION

Brooms have been available in industry and the home for centuries. Most prior art push brooms generally comprises brush head, an associated handle, and a connector suitable to secure the handle to the brush head. As early as 1871, U.S. Pat. No. 117,192 to William A. Middleton disclosed a broom having a brush head and a handle inserted into a connector that is a receptacle and the handle being held in place by a fastener or screws that are perpendicular to the brush head. A similar device is disclosed in U.S. Pat. No. 931, 290 to S. F. Frazier.

As discussed in U.S. Pat. No. 4,550,829 to Strahs, usually the brush head is constructed with an elongated transverse wood or other suitable, inflexible material base. The brush head is typically rectangular in plan view and the bottom surface of the brush head base has a plurality of bristles extending from it for floor-sweeping and cleaning purposes. The bristles may be natural hairs, synthetic fibers, or steel wires. Typically the top of the brush head a hole or opening centrally situated and adapted to receive and retain one end of an elongate rod which forms a handle. The handle is typically fabricated from wood or hollow metal and is positioned and secured within the opening of the brush head base. If the opening in the brush head base is tapered then the end of the elongate rod or handle is similarly tapered to provide the necessary friction engagement of the parts so that the push broom may be used. If the opening in the brush head base is threaded, then one end of the handle is similarly threaded so that the parts may be screwed together.

Numerous patents describe devices for push brooms which connect the handle to the brush head. U.S. Pat. No. 651,028 to W. A. Dryden, Sr. teaches a brush holder wherein the connector or bracket is triangular in shape with a hole substantially in the center. The bracket attaches to the brush head by means of a screw inserted in the hole and fastened through the brush head.

U.S. Pat. No. 5,568,668 to Margolin discloses a bent fastener brace as a connector which includes a first mid plate and wide central arcuate second portion attached to the handle as well as a bent pleat member. The plane of the fastener is folded about itself at an angle for insertion of the brush head on one side. On an opposite side, the fastener is attached to the top of the brush head. The fastener has a wide reverse pleat member formed from a reverse direction and extending downward vertically at right angles to the middle plate portion.

U.S. Pat. No. 4,901,392 to Shapiro et al also teaches a connector between the brush head and handle for a push broom. This connector adjustably attaches the handle to the brush head to allow the user of the push broom to twist the brush head in various directions thereby allowing the user to fit the brush head into narrow spaces by changing the angle between the brush head and handle.

U.S. Pat. No. 5,094,564 to Tedrick discloses a push broom handle clamp as the connector. The push broom includes a handle and brush head assembly characterized by a latching device in the form of a metal plate, cooperating together with the handle in the sturdy and properly interlocked position of the brush head, so as to eliminate loosening or falling out of the handle.

U.S. Pat. No. 4,169,297 to Weihrauch discloses a cleaning-implement handle securing device wherein the handle has a sprung forked end that is releasably securable to the brush head by engagement of fork arms in an aperture on the brush head by means of a clamping device engaging between the arms and movable by rotation, displacement or pivoting to spread the arms apart or draw them together.

As discussed in the prior art and most notably in U.S. Pat. No. 4,541,139 to Jones et al, there are problems with push brooms of the conventional design and those with removable handles. Push brooms of conventional design have the handle permanently affixed, through various means, to the brush head, so that when one component breaks or wears out the entire push broom must be replaced. Push brooms with removable handles through the use of threaded handle and socket are not satisfactory because the handle threads weaken the broom handle at that critical point and because the handle threads and/or the socket threads wear out, caused by the force exerted during use which is localized at this connection. Furthermore, the force at the pivot point is normal to the front and rear sides of the brush head during the back and forth sweeping motion applied by the user which aggravates the problem. These problems, inherent in these push brooms, cause the handles to repeatedly break at the point where the handles are attached to the brush head.

The U.S. Pat. No. 4,239,413 to Wludyka discloses a bracket which may be added to a push broom to provide additional lateral support for the handle. The use of this bracket assumes that the handle is otherwise attached to the push broom, since it is inadequate to form a means of attachment by itself. Furthermore, this device is relatively complex, and therefore relatively expensive to manufacture and difficult to install.

SUMMARY AND OBJECTS OF THE INVENTION

Accordingly, the shortcomings of the prior art are obviated by a push broom bracket device for connecting a rectangular-shaped broom brush head of a given length to a rod-shaped handle. The bracket device includes a sheet-like member in the form of an isosceles triangle having a base edge and two side edges of equal length extending to an apex, the base edge having a length which is greater than one-half of the given length but less than the given length of the brush head, the two side edges forming an angle of substantially 45° at the apex, and the sheet-like member being bent along a line extending substantially parallel to the base to form two substantially planar sections which intersect at an angle of substantially 35°, the section adjacent the base edge being adapted for attachment to a top portion of the brush head. The device also has a tube-like member, having a longitudinal central axis, attached to the sheet-like member at the apex with this central axis extending substantially perpendicular to the base edge, the tube-like member being adapted for attachment to one end of the handle. When attached to the brush head and the handle, the bracket device minimizes the lateral forces applied to the handle at the point of attachment during use of the broom.

Accordingly, it is an object of the present invention to provide a simple and efficient means for attaching the brush head of a push broom to the handle.

It is another object of the present invention is to provide a push broom bracket device that eliminates the problems of conventional push brooms such as the handles continuously breaking at their point of connection with the brush head of the push broom.

A further object of the present invention is to provide a push broom bracket device that prevents loosening of the handle.

A further object of the present invention is to provide a push broom bracket device which permits quick and easy replacement of the broom handle, if this becomes necessary.

Another object of the present invention to provide a push broom bracket device that is reliable and inexpensive to manufacture.

Still another object of the present invention is to provide a push broom bracket device that is simple and easy to use.

These and other features of the present invention are described in more detail in the following detailed description when taken with the drawings. The scope of the invention, however, is limited only by the claims appended hereto.

BRIEF DESCRIPTION OF THE DRAWINGS

FIG. 1 is a perspective view of the preferred embodiment of the push broom bracket device according to the invention, showing how the bracket device is used to attach a handle to a brush head of a push broom.

FIG. 2 is an enlarged elevational view of the front of the push broom bracket device of FIG. 1.

FIG. 3 is a side elevational view of the push broom bracket device of FIG. 1.

FIG. 4 is an elevational view of the back of the push broom bracket device of FIG. 1.

DETAILED DESCRIPTION OF THE PREFERRED EMBODIMENT

Figure 5:
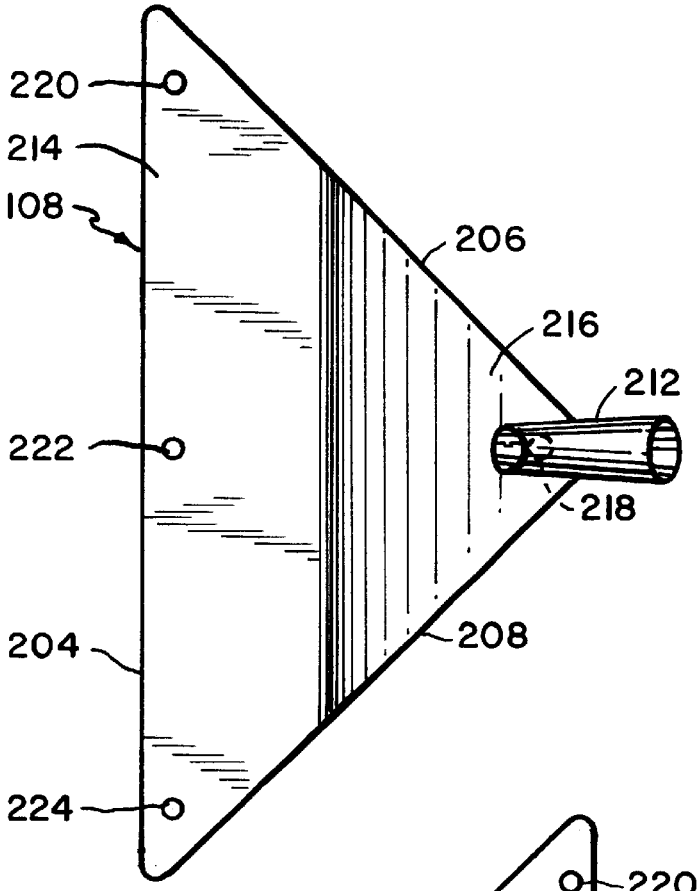
FIG. 5 is a top plan view of the push broom bracket device of FIG. 1.

The preferred embodiment of the present invention will now be described with reference to FIGS. 1–6 of the drawings. Whenever possible, the same reference numerals are used to reference the same elements in the figures.

FIG. 1 is a perspective view showing how the push broom bracket device according to the invention is used to attach a handle to a brush head of a push broom. The push broom 102 generally comprises brush head 104, an associated handle 106, and a connector or push broom bracket device 108 suitable to secure the handle 106 to the brush head 104 of the push broom 102. In FIG. 1, the brush head 104 is rectangular-shaped and has a given length. The handle 106 is rod-shaped, and the push broom bracket device 108 connects the rectangular-shaped brush head 104 of the push broom 102 to the rod-shaped handle 106.

FIG. 2 is an enlarged elevational view of the push broom bracket device 108 shown in FIG. 1. The push broom bracket device 108 comprises in combination a sheet-like member 202 in the form of an isosceles triangle having a base edge 204 and two side edges 206, 208 of equal length extending to an apex 210 (which is hidden in FIG. 2) and a tube-like member 212 which receives the handle 106.

The base edge 204 has a length which is greater than one-half of the given length of brush head 104 but less than the given length of brush head 104. The two side edges 206, 208 form an angle of substantially 45° at the apex 210. It is recognized that the angle can be somewhat less than 45° or greater than 45° in other embodiments of the invention; that is, in the range of 35°–55°; however, 45° is preferred. The sheet-like member 202 is bent along a line extending substantially parallel to the base edge 204 to form two substantially planar sections 214, 216 which intersect at an angle, indicated as $\phi$. This angle $\phi$ is in the range of 20°–50° and is preferably substantially 35°. The planar section 214 adjacent the base edge 204 is adapted for attachment to a top portion of the brush head 104.

The tube-like member 212 has a longitudinal central axis and is attached to the sheet-like member 202 at the apex 210 with the central axis extending substantially perpendicular to the base edge 204, the tube-like member 212 being adapted for attachment to one end of the handle 106 of the push broom 102. When attached to the brush head 104 and the handle 106, the push broom bracket device 108 minimizes the lateral forces applied to the handle 106 at the point of attachment during use of the push broom 102.

Preferably, the sheet-like member 202 is made of metal, such as rolled steel, for maximum strength. The tube-like member 212 is preferably also made of metal and is welded to the sheet-like member 202. The push broom bracket device 108 may also be fabricated from molded plastic.

The tube-like member 212 has an opening 218 on a side thereof for receipt of a screw, the screw being adapted to hold the handle 106 in place when the one end of the handle 106 is inserted into the tapered tube-like member 212.

FIG. 2 also depicts the planar section 214 of the sheet-like member 202 adjacent to the base edge 204 having a plurality of openings 220, 222, 224 therein arranged in at least one row substantially parallel to the base edge 204 for receipt of a plurality of screws. The screws are adapted to hold the sheet-like member 202 in place on the brush head 104.

FIG. 3 is a side view of the push broom bracket device 108 of FIG. 2. It clearly depicts the angle $\phi$ with which the planar sections 214, 216 of the sheet-like member 202 intersects. In FIG. 3, the tube-like member 212 is tapered along its central axis, enlarging from the end thereof closest to the base edge 204 of the sheet-like member 202 to the opposite open end adapted to receive one end of the broom handle 106. A portion of the handle 106 is depicted which is engaged into the tube-like member 212.

FIG. 4 is an elevational view of the back of push broom bracket device 108 according to FIG.2. The two side edges 206, 208 of equal length extending to form the apex 210 are shown. The tube-like member 212 is attached to the sheet-like member 202 at the apex 210. FIG. 4 also depicts the angle $\delta$ at which the side edges 206, 208 of the sheet-like member 202 intersect. This angle $\delta$ is preferably about 45°, but it can be slightly different within a range of 35°–55°.

Figure 6:
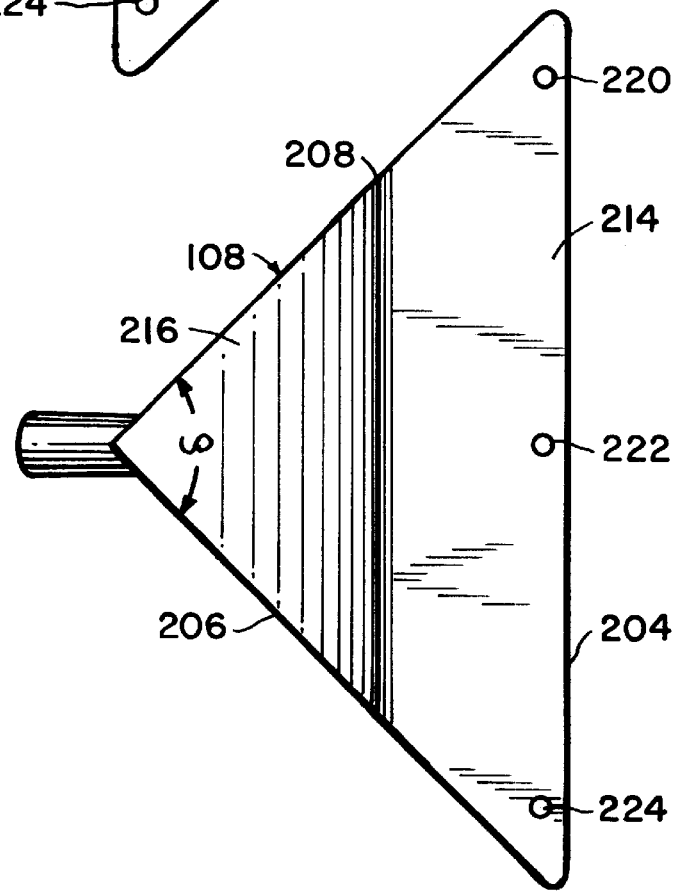
FIG. 6 is a bottom plan view of the push broom bracket device of FIG. 1.

FIG. 5 is a top plan view of the push broom bracket device 108 whereas FIG. 6 is a bottom plan view of the push broom bracket device 108 according to the invention. FIGS. 5 and 6 both depict the front and back, respectively, of the planar section 214 of the sheet-like member 202 which is adjacent to the base edge 204 and has a plurality of openings 220, 222, 224 therein arranged in at least one row substantially parallel to the base edge 204 for receipt of a plurality of screws. Depending upon the embodiment of the invention, there may be more or less openings arranged in one or two rows parallel to the longitudinal axis of the brush head 104. The screws, which are not shown, are adapted to hold the sheet-like member 202 in place on the brush head 104.

The two side edges 206, 208 of the sheet-like member 202 form an angle $\delta$ of substantially 45 degrees at the apex 210. FIG. 6 depicts the apex 210 while in FIG. 5, the apex 210 is obstructed by the tube-like member 212 which is affixed to the apex 210 by welding or other means. The tube-like member 212 has a longitudinal central axis and is attached to the sheet-like member 202 at the apex 210 with the central axis extending substantially perpendicular to the base edge 204, the tube-like member 212 being adapted to grip to one end of the handle 106 of the push broom 102. When attached to the brush head 104 and the handle 106, the push broom bracket device 108 minimizes the lateral forces applied to the handle 106 at the point of attachment during use of the push broom 102.

In FIG. 5, the sheet-like member 202 is bent along a line extending substantially parallel to the base edge 204 to form two substantially planar sections 214, 216 which intersect at the angle $\phi$ which is preferably about 35°.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined by the appended claims.

What is claimed is:

1. A push broom bracket device for connecting a rectangular-shaped broom brush head of a given length to a rod-shaped handle, said bracket device consisting essentially of:

(a) a sheet-like member in the form of an isosceles triangle having a base edge and two side edges of equal length extending to an apex, said base edge having a length which is greater than one-half of said given length but less than said given length of said brush head, said two side edges forming an angle $\delta$ in the range of 35°–55° at said apex, and said sheet-like member being bent along a line extending substantially parallel to said base edge to form two substantially planar sections which intersect at an angle $\phi$ in the range of 20°–50°, the section adjacent said base edge having a plurality of openings therein for receipt of a plurality of screws for attachment of the bracket device to a top portion of said brush head; and (b) a tube-like member, having a longitudinal central axis, attached to said sheet-like member at said apex with said central axis extending substantially perpendicular to said base edge, said tube-like member being adapted for attachment to one end of said handle;

whereby, when attached to said brush head and said handle, the bracket device minimizes the lateral forces applied to said handle at the point of attachment during use of the broom.

2. The bracket device recited in claim 1, wherein said sheet-like member is made of metal.

3. The bracket device recited in claim 2, wherein said metal is a rolled steel.

4. The bracket device recited in claim 2, wherein said tube-like member is made of metal and is welded to said sheet-like member.

5. The bracket device recited in claim 1, wherein said tube-like member is tapered along its central axis, enlarging from the end thereof closest to said base edge to the opposite open end adapted to receive said one end of said handle.

6. The bracket device recited in claim 5, wherein said tube-like member has an opening on a side thereof for receipt of a screw, said screw being adapted to hold said handle in place when said one end thereof is inserted in said tube-like member.

7. The bracket device recited in claim 1, wherein said plurality of openings in said sheet-like member are arranged in at least one row substantially parallel to said base edge for receipt of said plurality of screws, said screws being adapted to hold said sheet-like member in place on said brush head.

8. The bracket device recited in claim 1, wherein said angle $\phi$ is substantially 35°.

9. The bracket device recited in claim 1, wherein said angle $\delta$ is substantially 45°.

10. A push broom having a rectangular-shaped broom brush head and a rod-shaped handle, said handle being attached to said brush head by means of a bracket device as recited in claim 1.

* * * * *